US008191817B2

(12) United States Patent
Wohlfahrt et al.

(10) Patent No.: US 8,191,817 B2
(45) Date of Patent: Jun. 5, 2012

(54) PRESSURE ROLL OR CONTINUOUS PRESSURE BELT

(75) Inventors: Matthias Wohlfahrt, Heidenheim (DE); Roland Thomas, Heidenheim (DE); Walter Kaipf, Haunsheim (DE)

(73) Assignee: Voith Patent GmbH, Heidenheim (DE)

( * ) Notice: Subject to any disclaimer, the term of this patent is extended or adjusted under 35 U.S.C. 154(b) by 488 days.

(21) Appl. No.: 12/361,792

(22) Filed: Jan. 29, 2009

(65) Prior Publication Data

US 2009/0166466 A1 Jul. 2, 2009

Related U.S. Application Data

(63) Continuation of application No. PCT/EP2007/057176, filed on Jul. 12, 2007.

(30) Foreign Application Priority Data

Aug. 4, 2006 (DE) ..... 10 2006 036 875

(51) Int. Cl.
*B65H 18/16* (2006.01)
*B65H 18/26* (2006.01)

(52) U.S. Cl. ..... 242/541; 242/542.4; 242/547

(58) Field of Classification Search ..... 242/540, 242/541, 541.3, 541.4, 541.5, 541.6, 541.7, 242/542, 542.1, 542.2, 542.4, 547, 548
See application file for complete search history.

(56) References Cited

U.S. PATENT DOCUMENTS

| | | | | |
|---|---|---|---|---|
| 2,717,037 | A * | 9/1955 | Goodwillie | 242/525.6 |
| 5,071,083 | A * | 12/1991 | Tubota et al. | 242/547 |
| 5,531,396 | A | 7/1996 | Kinnunen et al. | |
| 5,785,273 | A | 7/1998 | Wolf et al. | |
| 6,311,921 | B1 | 11/2001 | Moller et al. | |
| 6,332,589 | B1 | 12/2001 | Moller et al. | |
| 6,820,834 | B1 | 11/2004 | Niskanen | |
| 2001/0040200 | A1 | 11/2001 | Kaipf et al. | |
| 2005/0205225 | A1 * | 9/2005 | Ahvenniemi et al. | 162/193 |

FOREIGN PATENT DOCUMENTS

| | | | |
|---|---|---|---|
| DE | 19908496 | A1 | 8/2000 |
| DE | 19950175 | A1 | 4/2001 |
| DE | 10150779 | A1 | 4/2003 |
| GB | 300476 | | 11/1928 |
| WO | 9962804 | | 12/1999 |

* cited by examiner

*Primary Examiner* — William E Dondero
(74) *Attorney, Agent, or Firm* — Taylor IP, P.C.

(57) ABSTRACT

A feature of a pressure roll or a continuous pressure belt for the formation of a reeling nip using a parent roll in a reel-up for the reeling up of a material web, in particular paper web or paperboard web, is that the roll surface or, respectively, belt surface adjacent to the reeling nip has helical, an at least single-start groove, the depth of which is in the range from about 0.4 mm to about 1.5 mm, and the maximum width of which is in the range from about 35 to 60 mm.

26 Claims, 4 Drawing Sheets

PRESSURE ROLL OR CONTINUOUS PRESSURE BELT

CROSS REFERENCE TO RELATED APPLICATIONS

This is a continuation of PCT application No. PCT/EP2007/057176, entitled "PRESSURE ROLL OR CONTINUOUS PRESSURE BELT", filed Jul. 12, 2007, which is incorporated herein by reference.

BACKGROUND OF THE INVENTION

1. Field of the Invention

The present invention relates to a reel drum roll or a continuous pressure belt for the formation of a reeling nip, comprising a parent roll in a reel-up for reeling up a material web, especially a paper or cardboard web. It further relates to a reel-up, comprising a reel drum or, respectively, a continuous pressure belt of this type.

2. Description of the Related Art

Reel drums as well as reel-ups for reeling up a material web are known in the art. Attempts have been made to avoid trapping of air during reeling up of the material web through appropriate pressing of the reel drum or an air squeeze element or similar device against the parent roll. Grooved reel drums have also been utilized in order to avoid floating of the material web. In practice it has, however, been demonstrated that the avoidance of air entrapment thus far has been insufficient.

What is needed in the art is an improved reel drum or, respectively, a pressure belt, as well as an improved reel-up for reeling up a material web with which it would be ensured that the entrapped air is removed quickly and reliably.

SUMMARY OF THE INVENTION

The present invention provides a reel drum, or continuous belt respectively, wherein the reel drum surface or, respectively, the belt surface adjacent to the reeling nip has at least a single start helical groove which has a depth in the range of approximately 0.4 mm to approximately 1.5 mm, for example, approximately 0.8 mm and a maximum width in the range of approximately 35 mm to approximately 60 mm, for example, approximately 40 mm.

The present invention ensures that the air which is trapped during reeling up of the material web is quickly and reliably removed. During this process, the material web dips slightly into the groove, thereby forming laterally restricted air chambers for the reeled in air. Due to the helical progression of the groove the air is pumped to the outside.

According to one embodiment of the present invention, the drum reel or pressure belt has a helical groove progressing in the direction of the drum axis, that is, transversely to the direction of belt travel viewed from a central drum or belt location toward the outside.

The grooving is designed at least partially as a single start. According to one embodiment this grooving is designed to be at least partially multiple-start. Here, it is advantageous if the various starts are distributed uniformly across the drum circumference or, respectively, across the contact surface of the belt which is adjacent to the reeling nip. The grooving may also be designed to be 1- to 5-start. It can be at least partially 2-start, at least partially 3-start or at least partially 4-start. Because of the multiple leads more air can be removed.

The water removal can also be improved through a certain cross sectional profile. According to one the groove has a concave cross sectional profile, for example, from radially inside to outside. According to another embodiment the groove may also have an at least partially lenticular profile, for example, from radially inside to outside. It may also be at least partially backswept. Also conceivable would be a rectangular or trapezoidal cross sectional profile.

The groove lead is at least partially in the range of approximately 300 mm to approximately 1500 mm, for example, in the range of 600 mm. In the area of the drum center a bridge in the range of 0 mm to approximately 200 mm can remain.

According to another embodiment of the reel drum or, respectively, the pressure belt of the present invention, the number of starts may be adapted to the lead in a manner that a bridge in the range of between approximately 100 mm and approximately 400 mm, for example, in the range of 200 mm remains.

The reel drum has a diameter of greater than approximately 700 mm for example, greater than 1000 mm. The grooving may be provided directly on the drum body, or in on a belt or similar device surrounding the drum.

According to another embodiment of the present invention, the drum or, respectively, the belt is driven. This allows for the speed relative to the parent roll to be controlled, resulting in that the water removal effect can be further optimized. This allows the slippage to be controlled appropriately.

According to the present invention, the surface of the reel drum or, respectively, of the continuous belt or a belt surrounding the roll in contact with the parent roll is provided with a grooving of a certain geometry. It is important that the grooving progress essentially helically, starting from a central location toward the outside. The grooving comes into contact with the surface of the parent roll which, because of the entrapped, air is soft. The material web dips slightly into the groove and forms a laterally limited air chamber for the entrapped air. Due to the helical progression, the air is again pumped to the outside.

The efficiency depends upon the geometry of the groove. The grooving may be multiplex. This means, for example, 2- or 3-start or at least 4-start, thereby enabling more air to be removed. The shape of the groove can be concave, lenticular, rectangular, trapezoidal, etc.

The reel drum or Pope type reel or, respectively, the continuous pressure belt, is driven in order to be able to control the speed relative to the parent roll. This allows the water removal effect to be further controlled, whereby the slippage can be controlled accordingly. Because the contact surface with the parent roll is reduced as a consequence of the grooving it is advantageous if the nip force is controlled and/or adjusted since fluctuations greatly influence the surface pressure. This could cause marking of the material web. With the present invention it is possible to avoid bubble formation or, at least, to establish a stable bubble.

The groove can start on both sides, offset between 0° and 360/ng (ng=the number of starts), preferably 360/ng/2. This means, the groove starts in the center and not at a location on the sides. An overlap of 0 to 100 mm, for example, 0 mm may occur in the center. The number of starts can be adapted to the lead such that a bridge in the range of approximately 100 to approximately 400 mm, for example, in the range of 200 mm remains.

The reel-up of the present invention is characterized in that it includes a reel drum or continuous pressure belt which, together with a parent roll, create a reeling nip through which a material web, especially a paper or cardboard web, is run in order to subsequently be reeled up onto the patent roll.

The reel drum, the pressure belt or, the reel-up of the present invention can be utilized especially advantageously to reel up a material web, especially a paper or cardboard web, having an air permeability is <50 ml/min according to Bendtsen according to DIN 53120-1.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
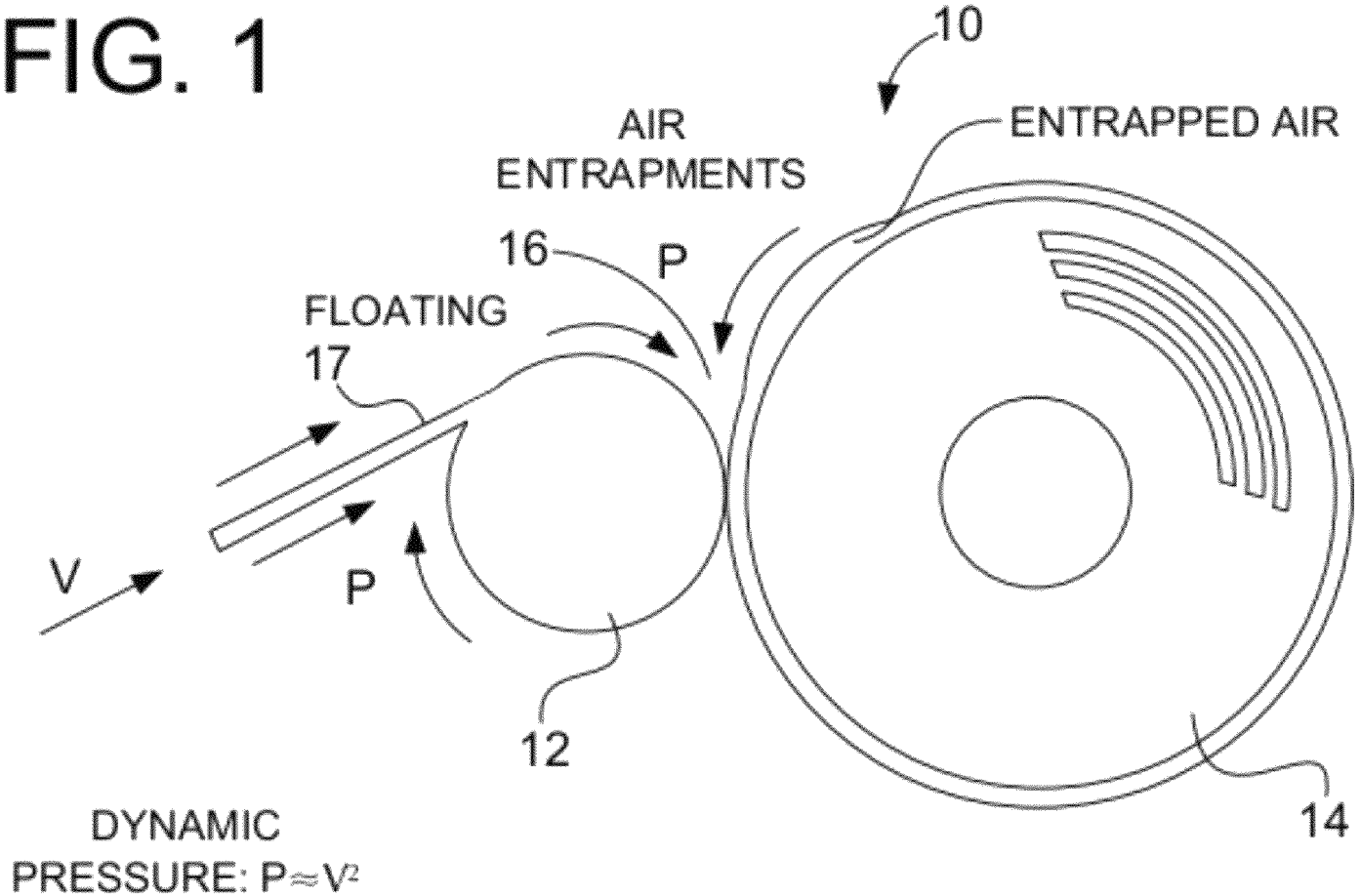
FIG. 1 is a schematic illustration of a reel-up with a reel drum assigned to the parent roll according to the present invention.

Referring now to the drawings, and more particularly to FIG. 1, there is shown a schematic illustration of an example of an embodiment of reel-up 10, equipped with drum reel 12 which, together with parent roll 14, creates reeling nip 16 through which material web 17 is run in order to subsequently be reeled up onto parent roll 14.

As indicated in FIG. 1, floating of material web 17 onto reel drum 12, as well as air entrapments during reeling onto parent roll 14, may occur in known conventional reel-ups of this type. Such floating, as well as such air entrapments, can be largely avoided with the present invention of the reel drum or, respectively, continuous belt which could be utilized in place of the reel drum. The arrows denoting movement in FIG. 1 illustrate that reel drum 12 is driven and that parent roll 14 may also be driven.

Figure 2:
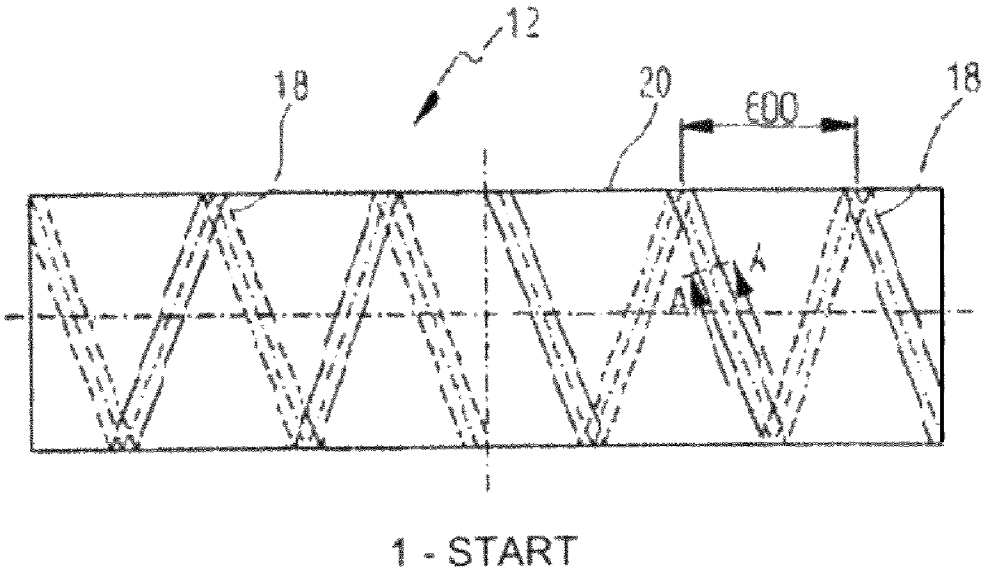
FIG. 2 is a schematic illustration of an embodiment of a reel drum with a single-start groove, according to the present invention.
Figure 2:
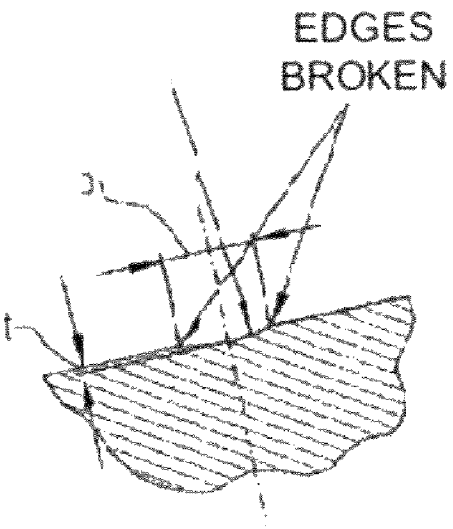

The right depiction illustrated in FIG. 2 is a schematic illustration of an embodiment of the present invention including reel drum 12 with single-start groove 18, as could be utilized, for example, in the reel-up illustrated in FIG. 1.

Roll surface 20 adjacent to reeling nip 14 (see FIG. 1) has helical groove 18, which is single-start in this example and which has a depth t in the range of approximately 0.4 mm to approximately 1.5 mm, for example, approximately 0.8 mm and a maximum width b in the range of approximately 35 to approximately 60 mm.

The left depiction in FIG. 2 shows a cross section along line A-A. As can be seen in this depiction, on the left, in FIG. 2, of the groove the edges are broken.

Figure 3:
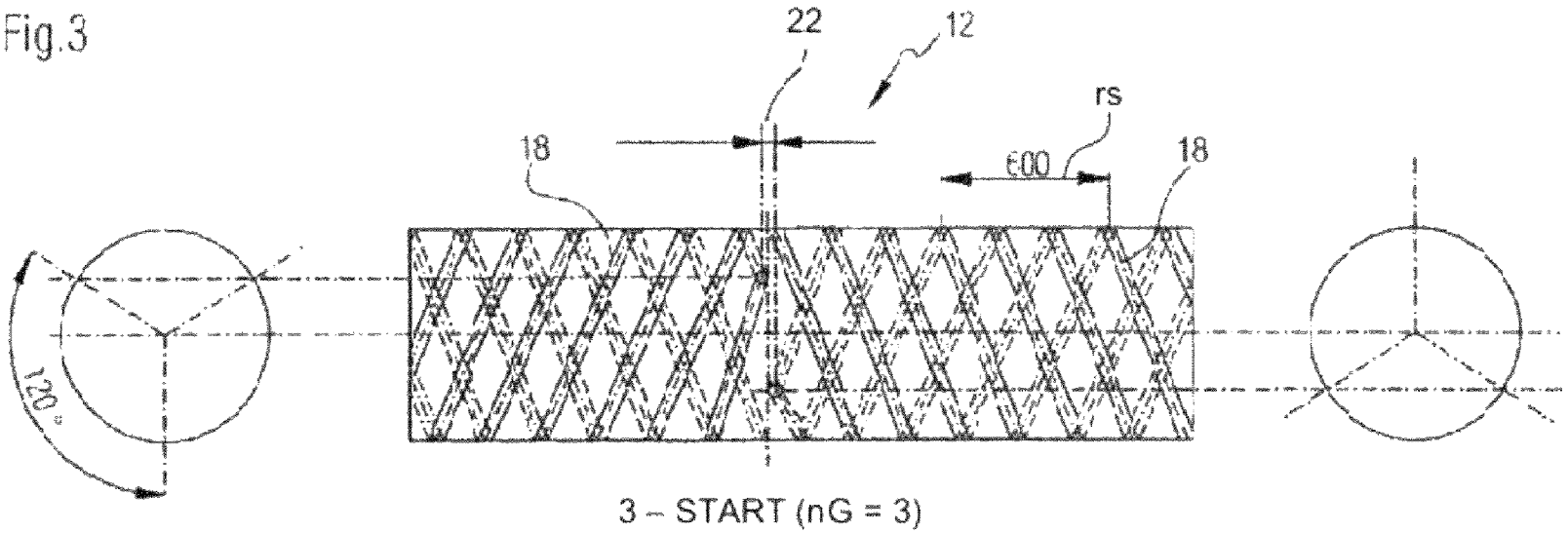
FIG. 3 is a schematic illustration of an embodiment of a reel drum with a 3-start groove according to the present invention.
Figure 4:
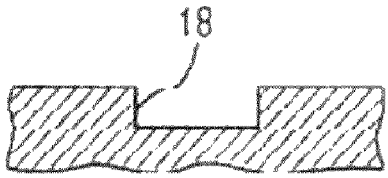
FIGS. 4-7 are schematic illustrations of examples of cross sectional profiles of grooves.
Figure 5:
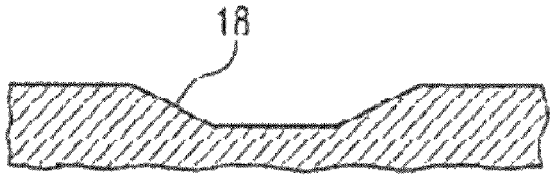

The groove lead rs can at least partially be in the range of approximately 300 mm to approximately 1500 mm, whereby in this example it is in the range, for example, of approximately 600 mm. FIG. 3 is a schematic illustration of an embodiment according to the present invention of reel drum 12 with 3-start grooves (ng=3). Also in this example, groove lead rs is shown to be approximately 600 mm. An overlap in particular of 0 to 100 mm, for example, 0 mm may be proposed in the central drum area. The number of starts can thereby be adapted to the lead so that bridge 22, in the range of particularly approximately 100 to approximately 200 mm, remains.

Figure 6:
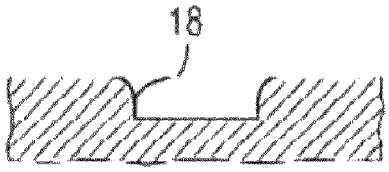
Figure 7:
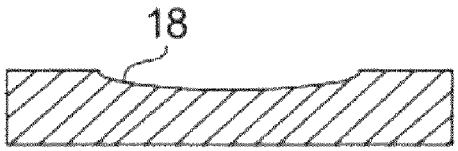

FIGS. 4 to 7 depict embodiments of the present invention having a cross sectional profile of groove 18. Groove 18 can at least partially possess a rectangular (see FIG. 4), a trapezoidal (see FIG. 5) or any desired other cross profile form, for example, one as illustrated in FIG. 6 where the two lateral edges of groove 18 are shaped differently. In this example, the right edge is continuously rounded while the left edge is angled. Groove 18 can also be of lenticular form, as illustrated in FIG. 7.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

10 Reel-up
12 Reel drum
14 Parent roll
16 Reeling nip
17 Material web
18 Groove
20 Roll surface
22 Bridge
b Width
rs Groove lead
t Depth

What is claimed is:

1. A machine for the production of a fiber web, said machine configured to form a reeling nip, said machine comprising:

a reel-up;

a parent roll in said reel-up for reeling up the fiber web;

a reel drum adjacent to the reeling nip, said reel drum having a surface with a plurality of helical groove starts having a depth in the range of between approximately 0.4 mm to 1.5 mm, and a maximum width in the range of between approximately 35 mm to 60 mm, said plurality of starts having a bridge therebetween in a central reel drum location.

2. The machine according to claim 1, wherein said groove has a depth of approximately 0.8 mm.

3. The machine according to claim 2, wherein said groove has a maximum width of approximately 40 mm.

4. The machine according to claim 3, wherein the reel drum has an axis, said helical grooves progressing in a direction of said axis when viewed from said central reel drum location.

5. The machine according to claim 4, wherein said groove is more than a 2-start.

6. The machine according to claim 4, wherein the reel drum has a circumference adjacent to the reeling nip, said plurality of starts being distributed uniformly across said circumference.

7. The machine according to claim 6, wherein said plurality of helical groove starts is one of a 2- to 5-start.

8. The machine according to claim 6, wherein said plurality of helical groove starts is one of a 3- to 5-start.

9. The machine according to claim 4, wherein said plurality of helical groove starts is one of a 2-to 5-start.

10. The machine according to claim 1, wherein said groove has a concave cross sectional profile.

11. The machine according to claim 10, wherein said concave cross sectional profile is from radially inside to outside.

12. The machine according to claim 1, wherein said groove has an at least partially lenticular profile.

13. The machine according to claim 12, wherein said at least partially lenticular profile is from radially inside to outside.

14. The machine according to claim 1, wherein said groove has an at least partially rectangular cross-sectional profile.

15. The machine according to claim 1, wherein said groove has an at least partially trapezoidal cross sectional profile.

16. The machine according to claim 1, wherein said groove has a groove lead in a range of approximately 300 mm to approximately 1500 mm.

17. The machine according to claim 16, wherein said groove lead is approximately 600 mm.

18. The machine according to claim 16, further comprising a bridge remaining in an area of the reel drum center, said bridge is in a range of approximately 0 mm to approximately 200 mm.

19. The machine according to claim 16, wherein said at least one start is adapted to said lead such that said bridge remains, said bridge being in a range between approximately 100 mm and approximately 400 mm.

20. The machine according to claim 19, wherein said bridge is approximately 200 mm.

21. The machine according to claim 20, wherein the reel drum has a diameter greater than 700 mm.

22. The machine according to claim 21, wherein the reel drum has a diameter greater than 1000 mm.

23. The machine according to claim 16, wherein said material web has an air permeability of greater than approximately 50 ml/min according to a Bendtsen method of DIN 53120-1.

24. The machine according to claim 1, wherein the reel drum has a body, said groove being on said body.

25. The machine according to claim 24, wherein the drum wheel is driven.

26. The machine according to claim 25, wherein said parent roll and the reel drum are configured to form the reeling nip through which a material web is run, said material web being reeled onto said parent roll.

* * * * *